United States Patent [19]

Mayer

[11] Patent Number: 5,039,075

[45] Date of Patent: Aug. 13, 1991

[54] AUTOMATIC DOCUMENT GATHERING AND PERSONALIZATION SYSTEM

[75] Inventor: Theodore W. Mayer, Chicago, Ill.

[73] Assignee: R. R. Donnelley & Sons Company, Lisle, Ill.

[21] Appl. No.: 379,275

[22] Filed: Jul. 12, 1989

[51] Int. Cl.[5] ..... B41F 13/54

[52] U.S. Cl. ..... 270/1.1; 270/54; 270/58

[58] Field of Search ..... 270/1.1, 52, 54, 55, 270/57, 58

[56] References Cited

U.S. PATENT DOCUMENTS

| | | | |
|---|---|---|---|
| Re. 31,710 | 10/1984 | Jackson | 270/57 |
| 3,819,173 | 6/1974 | Anderson et al. | 270/54 |
| 3,891,492 | 6/1975 | Watson | 156/351 |
| 3,899,165 | 8/1975 | Abram et al. | 270/54 |
| 3,917,252 | 11/1975 | Harder et al. | 270/58 |
| 4,022,455 | 5/1977 | Newsome et al. | 270/54 |
| 4,121,818 | 10/1978 | Riley et al. | 270/54 |
| 4,384,196 | 5/1983 | McCumber et al. | 235/375 |
| 4,395,031 | 7/1983 | Gruber et al. | 270/54 |
| 4,546,962 | 10/1985 | Backman | 270/54 |
| 4,576,370 | 3/1986 | Jackson | 270/54 |
| 4,585,220 | 4/1986 | Zemke et al. | 270/54 |
| 4,639,873 | 1/1987 | Baggarly et al. | 364/466 |
| 4,641,753 | 2/1987 | Tamada | 209/546 |
| 4,707,790 | 11/1987 | Gomes et al. | 364/478 |
| 4,733,359 | 3/1988 | Luperti et al. | 364/478 |
| 4,752,675 | 6/1988 | Zetmeir | 235/375 |
| 4,789,147 | 12/1988 | Berger et al. | 270/1.1 |
| 4,799,661 | 1/1989 | Nail | 270/54 |

FOREIGN PATENT DOCUMENTS

| | | | |
|---|---|---|---|
| 3421208 | 12/1985 | Fed. Rep. of Germany | 270/58 |

OTHER PUBLICATIONS

Leibinger, Numbering Machines and Systems Brochure.

*Primary Examiner*—Edward K. Look
*Assistant Examiner*—Therese M. Newholm
*Attorney, Agent, or Firm*—Arnold, White & Durkee

[57] ABSTRACT

An automated system gathers coupons into sets that are individually customized for different addresses. The system involves recording a list of addressee information and codes for identifying the various addressees. The list is used to control the feeding of coupons from each of several feeder units to a conveyor track. Each feeder unit is disposed adjacent to each coupon group for removing coupons therefrom, and each feeder unit contains a printing head for printing an addressee code on each coupon as it is fed to the conveyor track. A processor controls the feeding of the coupons according to the recorded list such that the addressee coded coupons are collected into coupon sets, and the coupons of each set are printed with the same addressee code.

18 Claims, 6 Drawing Sheets

AUTOMATIC DOCUMENT GATHERING AND PERSONALIZATION SYSTEM

TECHNICAL FIELD

The present invention relates generally to directly mailed documents, and, more particularly, to the practice of selectively gathering and preparing response documents for direct mail applications.

BACKGROUND ART

Response documents are commonly used in direct mail advertising to solicit responses from consumers. Examples of response documents include discount coupons, magazine subscription literature and product survey questionnaires. Typically, the addressee's name and address is recorded or coded on one or more response documents, the documents are mailed, and, ideally, the addressee then directly or indirectly returns the response document to the sender. Once returned, the response documents are used to determine which addressees responded, and, in some direct mail applications, how they responded.

A typical direct mail application employs response documents in magazines to solicit magazine subscription renewals. An example of this type of application is described in Anderson et al. U.S. Pat. No. 3,819,173. In that patent, an addressee coded subscription card is inserted into an addressee-customized magazine while the magazine is being produced.

In a less common direct mail application, response documents in the form of discount coupons are coded with addressee information according to demographic information. This application entails selectively gathering different coupons for different addressees. The demographic information is used to determine which coupons would be most favorably responded to by each designated addressee. To effectively implement this technique, however, a substantial amount of manual assistance is required. For example, one such technique requires manually reviewing a list of coupons that are to be mailed to each addressee and then manually gathering the corresponding coupons. An addressee code is then stamped on each coupon before packaging and mailing the coupons to the addressee.

Recently, there has been a need to mail large volumes of different response documents to different addressees. Additionally, for efficient processing, the different response documents that are sent to each designated addressee are required to be coded with information that identifies the particular addressee. Unfortunately, known direct mail techniques are not useful in meeting this recent need. For example, direct mail techniques that require a substantial amount of manual assistance, such as the technique described above, are intolerably burdensome. The volume of addressees and response documents renders such a technique inefficient and prohibitively expensive.

DISCLOSURE OF INVENTION

A general object of the present invention is to provide a system and method for preparing response document packages automatically and efficiently.

A more particular object of the present invention is to provide an automated system and a corresponding method for selectively printing coupons with addressee codes and for selectively gathering the coupons for direct mail packages to be mailed to addressees designated by such codes.

In accordance with a preferred embodiment of the present invention, the foregoing objects are realized by providing an automated system for gathering sets of coupons which have been customized for specific addressee types. The addressee types and corresponding addressee codes are recorded on a magnetic tape. In response to this recorded information, a processor controls a plurality of feeder stations which, in turn, provide addressee coded coupons to a conveyor track. Each feeder station includes a set of coupons, a printing head for printing one of the addressee codes on the coupons and a coupon feeder for feeding the coupons. The conveyor track receives the fed coupons, moves coupons from one feeder station to the next so that each feeder station has an opportunity to feed one of its coupons into each set, thereby collecting addressee coded coupons into coupon sets. The processor controls the manner in which the addressee coded coupons are collected so that the coupons of each set are printed with the same addressee code.

Each feeder station printing head preferably includes a counter which corresponds to the addressee code which is printed on each coupon. The counter is incremented each time the conveyor track moves the coupons, and addressee positions are designated serially on the conveyor track so that each position receives a stack of coupons.

An alternate embodiment of the present invention is similar to the one previously described. Unlike that system, however, each feeder station in this alternate system does not include a printing head. A single printing mechanism is included in the alternate system separate from the feeder stations. Additionally, multiple positions are assigned serially along the conveyor track to gather coupon sets in rows, rather than in stacks. This allows the printing mechanism to print a designated addressee code on each of the coupons after the coupons are fed from the feeder stations and before the coupons are gathered into envelopes for mailing to the addressees.

BRIEF DESCRIPTION OF THE DRAWINGS

Other objects and advantages of the invention will become apparent upon reading the following detailed description and upon reference to the accompanying drawings, in which.

Figure 1:
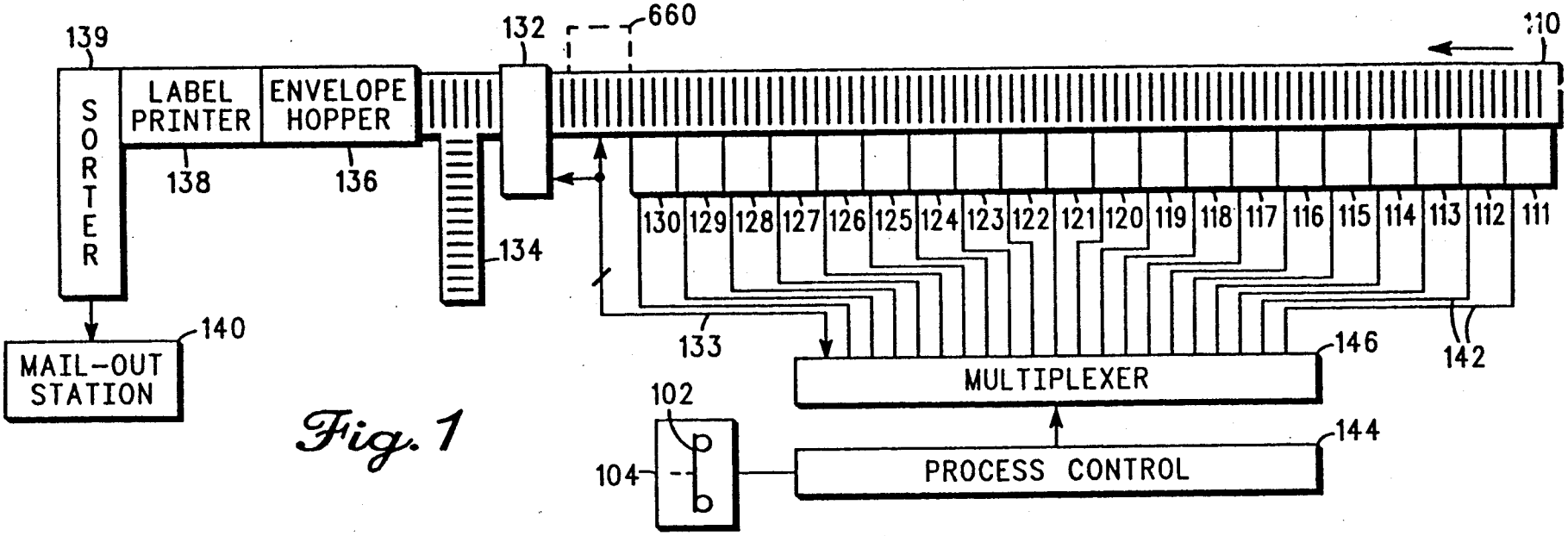
FIG. 1 is a block diagram of a document gathering and personalization system, according to the present invention.

While the invention is susceptible to various modifications and alternative forms, specific embodiments thereof have been shown by way of example in the drawings and will herein be described in detail. It should be understood, however, that it is not intended to limit the invention to the particular forms disclosed. On the contrary, the intention is to cover all modifications, equivalents, and alternatives falling within the spirit and scope of the invention as defined by the appended claims.

DETAILED DESCRIPTION OF PREFERRED EMBODIMENTS

The present invention is directed to the practice of preparing direct mail packages wherein each package contains a set of response documents which is customized for designated types of addressees. The present invention may be used to mail a variety of document types for practically any addressee type. For example, the documents may be in the form of advertisement literature, product survey forms or a combination thereof, and the addressee type may range from an individual residing at an individual address to a zip code range. However, the present invention is particularly useful for preparing direct mail coupon packages, each package containing different coupons which have been particularly selected for specific individuals having unique postal addresses. It is in this context that the present invention is discussed.

Figure 3:
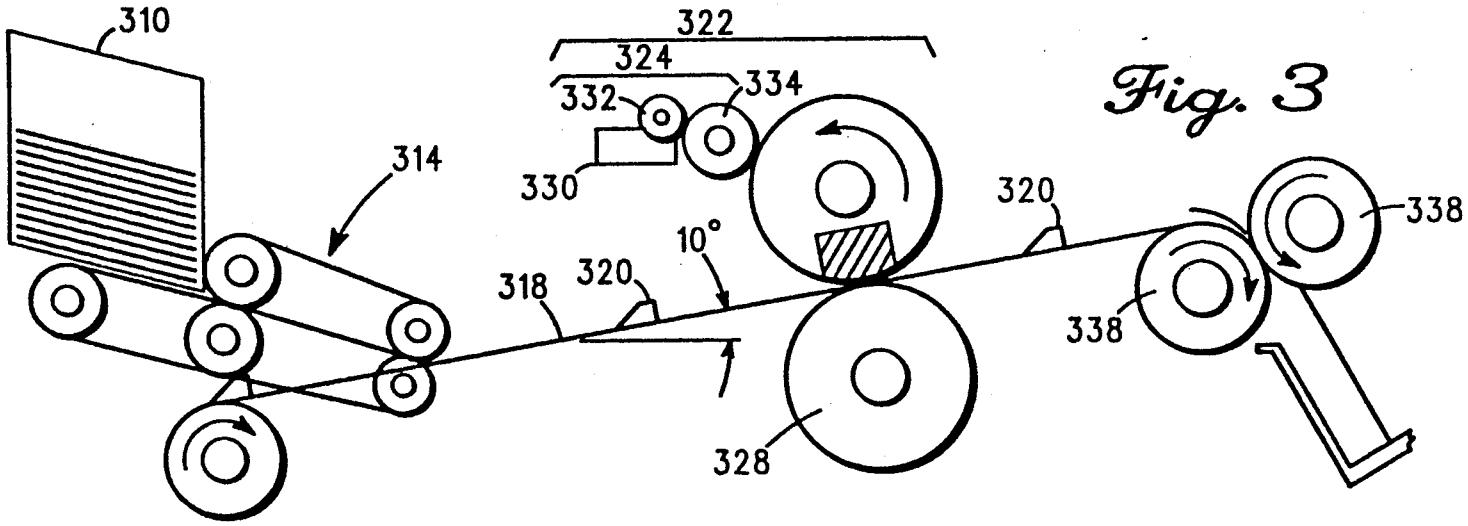
FIG. 3 illustrates a side view of one of the feeder stations 111–130 of FIG. 1.

This coupon application is accomplished using a system which employs a plurality of coupon feeder stations along a conveyor track. In FIG. 1, such a system is illustrated with the conveyor track depicted as 110 and the feeder stations depicted as 111–130. While the feeder stations 111–130 will be further described and illustrated in connection with FIG. 3, FIG. 1 illustrates the overall system operation.

System control is provided by a process controller 144. The process controller 144 is coupled to the feeder stations 111—130 through a multiplexer 146 and a plurality of leads 142 which carry instructions from the process controller 144. The instructions are based upon known subscriber data stored on a magnetic tape 102. This stored data includes a list of addressee codes which designate the addressees that are to receive the direct mail packages, and information designating the coupons that are to be received by each addressee. Using a conventional reel to reel tape drive 104 to read this information, the process controller 144 instructs the conveyor track 110 to move coupons fed by the feeder stations toward a conventional mail-out station 140.

Between the feeder stations 111–130 and the mail-out station 140, the coupons are processed using a caliper 132, a reject conveyor 134, an envelope hopper 136, a label printer 138 and a zip code sorter and separator 139. Each of these devices (132, 134, 136, 138 and 139) are conventional and commercially available from a variety of sources. The caliper 132, e.g., a master caliper available from William B. McCain Co. of Chicago, Ill., measures the number of coupons that are designated for each addressee coupon set. To perform this function, via leads 133, the process controller 144 transmits appropriate control signals to the caliper 132 and timing signals to the conveyor track 110.

The reject conveyor 134 is used to eject coupon sets from the conveyor 110 path when the caliper 132 indicates an error. In response to such errors, the erroneously formed coupon sets are automatically extracted from the conveyor path onto the reject conveyor 134.

The envelope hopper 136 collects the coupons of each set, stuffs them into envelopes and then seals the envelopes.

After processing by the envelope hopper 136, the envelopes are printed with the appropriate name and address by a label printer 138. The envelopes are then processed by the zip code sorter and separator 139. The zip code sorter and separator 139 may be implemented using a conventional deflecting device.

In the preferred embodiment, each of the feeder stations 111–130 includes a group (or bin) of coupons. The coupons are preferably stacked but may be in web form or another form. In each bin, the coupons are identical. However, no two bins contain the same type of coupon. Thus, in the embodiment of FIG. 1, this allows twenty different types of coupons to be included with any one addressee direct mail package.

Just before a feeder station feeds a coupon onto the conveyor track 110, the feeder station inscribes the coupon with an addressee code. The addressee codes are used to maintain a correspondence between the coupons and the addressees to which the coupons are mailed. Coupons that are used by the addressees are returned to the mailer for analysis and future marketing applications.

The addressee codes may be inscribed onto the coupons in any one of a variety of forms. For instance, the coupons may be hole punched, a set of numeric, alphabetic or alphanumeric characters may be printed on each coupon, or a standardized bar code may be printed on the coupon. To accommodate optical scanning equipment and to expedite the reading process of the addressee codes, a standardized bar code is preferred.

The conveyor track 110 selectively gathers the addressee coded coupons from each feeder station one cycle at a time. A cycle is defined as the movement of a coupon on the conveyor track 110 between two adjacent feeder stations. Each addressee is assigned a conveyor track position, and at each cycle the process controller 144, based on the information on the tape 102, selectively instructs certain feeder stations to code and feed their coupons onto the respective conveyor track positions in front of those feeder stations. As the conveyor track 110 moves each conveyor track position in front of the feeder stations 111–130, the feeder stations inscribe codes onto their coupons and feed those coupons onto the conveyor track positions to form addressee packages consisting of different coupon types with the coupons in each package having the same addressee code inscribed thereon.

Consider, for example, two addressee coded direct mail packages produced from the system illustrated in FIG. 1. The system in FIG. 1 includes twenty feeder stations; thus, twenty types of coupons. Since each addressee is assigned a conveyor track position, two conveyor track positions carry coupons for two addressee coded direct mail packages. This means that the system is capable of producing two direct mail packages wherein each package is capable of containing any or all of the twenty coupons types.

Figure 2A:
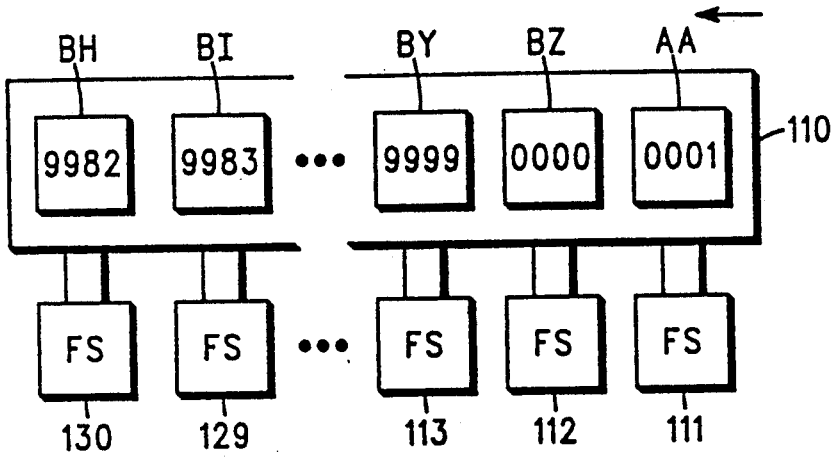
FIGS. 2*a* through 2*d* comprise a series of illustrations depicting the movement of documents along the conveyor track 110 of FIG. 1.

This process is particularly illustrated in FIGS. 2*a*–2*d* through a series of conveyor track position diagrams. The initial state of the conveyor track 110 is illustrated in FIG. 2*a* wherein conveyor track positions AA, BZ, BY, . . . BI, and BH are numbered with corresponding addressee codes: 0001, 0000, 9999, . . . 9983, 9982, respectively. Both the conveyor track positions and the numbers associated with the positions shift one feeder station to the left with each cycle, as illustrated through the progression of FIGS. 2*a*-2*d*.

The conveyor track positions represent the addressee codes (numbers) that are printed at each respective feeder station 111-130. The addressee code is incremented with each cycle so that the addressee code changes with each new conveyor track position. At initialization, as shown in FIG. 2*a*, the printer at the feeder station 111 is initialized to 0001, the printer of the feeder station 112 is initialized to 0000, etc. Accordingly, the number corresponding to the addressee code is incremented with each conveyor track cycle so that each conveyor track position is eventually moved in front of each feeder station.

After initialization and in response to process controller instructions, the feeder station 111 can output a code printed coupon at the conveyor track position AA. The process controller 144 will not instruct the remaining feeder stations 112-130 to output a code printed coupon from the initialization state. As the following discussion will indicate, this is because the conveyor track position AA is the only position which currently corresponds to an addressee package.

Figure 2B:
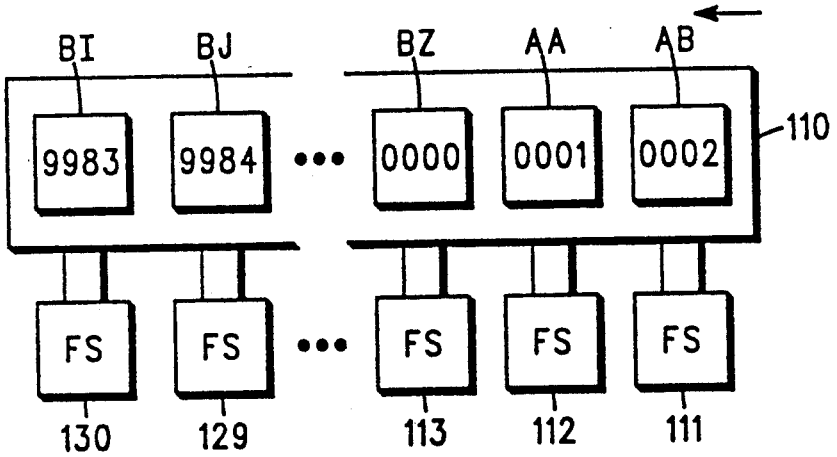

In FIG. 2*b*, the position of the conveyor track is shown after the first conveyor track cycle. The conveyor track position AA is in front of the feeder station 112 and a new conveyor track position AB is established in front of the feeder station 111 to correspond to a second addressee package. The feeder station printers are incremented so that their numbers correspond to the next addressee code. In response to process controller instructions, the feeder stations 111 and 112 can output code printed coupons at the conveyor track positions AA and AB to begin the development of the first two addressee packages.

Figure 2C:
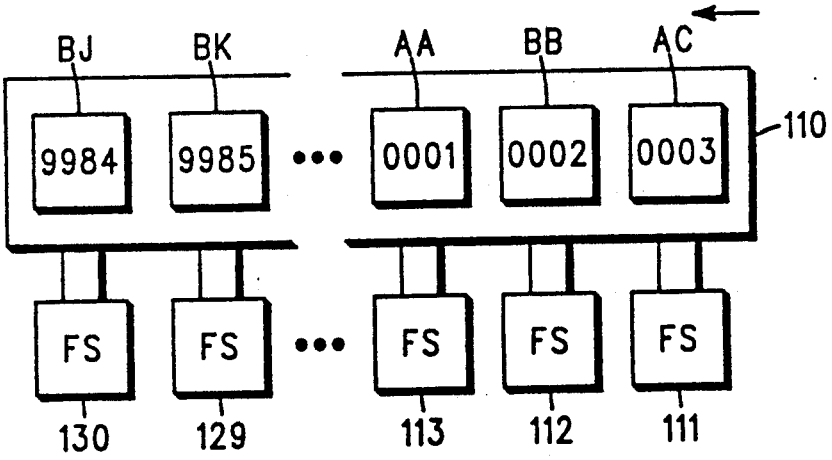

In FIG. 2*c*, the position of the conveyor track is shown after the second conveyor track cycle. The conveyor track position AA is before the feeder station 113, the conveyor track position AB is before the feeder station 112, and a third conveyor track position AC is established before the feeder station 111 to correspond to a third addressee package. The feeder station printers are again incremented so that their numbers correspond to the respective addressee packages, as shown in FIG. 2*c*. The feeder stations 111, 112 and 113 can now output code printed coupons at the conveyor track positions AA, AB and AC for the development of the first three addressee packages.

Figure 2D:
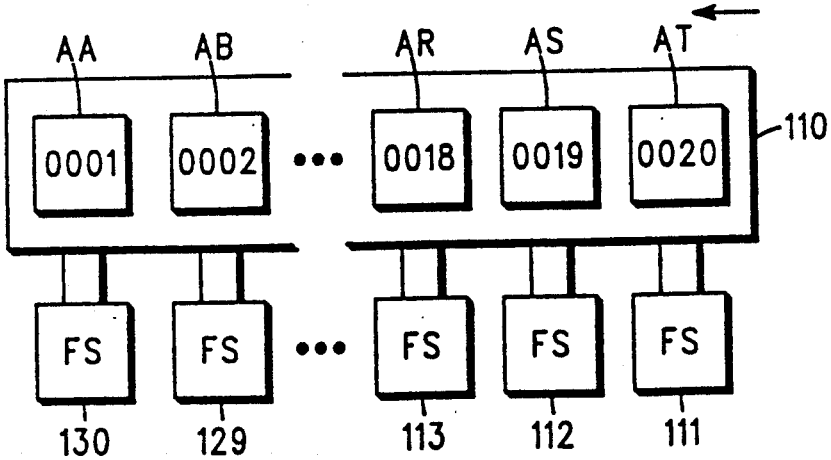

In FIG. 2*d*, the position of the conveyor track is shown after the nineteenth conveyor track cycle. The conveyor track position AA is before the feeder station 130, the conveyor track position AB is before the feeder station 129, . . . and a twentieth conveyor track position AT is established before the feeder station 111 to correspond to the twentieth addressee package. The feeder station printers are incremented so that their numbers correspond to the respective addressee packages, as shown in FIG. 2*d*.

At this juncture of the coupon gathering process, the process controller has been able to instruct at least one of the feeder stations 111-130 to feed its associated coupons onto at least one of the conveyor track positions AA-AT. When conveyor track position AT is in front of the feeder station 130, the process controller has been able to instruct every one of the feeder stations 111-130 to feed one of its associated coupons onto anyone of the conveyor track positions AA-AT.

This process continues with new conveyor track positions entering the system from the right side, and with the feeder stations feeding addressee coded coupons onto the respective conveyor track positions. The process ends once all designated conveyor track positions have collected the designated addressee coded coupons from all of the selected feeder stations.

Referring now to FIG. 3, one of the feeder stations 111-130 is shown in detail. The previously referred to coupon bin 310 is shown supported by a conventional electronically operated feeder unit 314, for example, model no. 700, available from Longford, Inc. of Scarborough, Ontario, Canada. Coupons are extracted from the coupon bin 310 in response to instructions from the process controller which is electronically coupled to the feeder unit 314.

From the feeder unit 314, each coupon is transferred to a printer 322 via transfer chain 318 using a guide 320.

The printer 322 includes an ink roller assembly 324, a sequential numbering unit 326 and an impression roller 328. The ink roller assembly 324 includes an ink pan 330, a cylindrically shaped ink pad 332 for extracting the ink from the ink pan 330 and an ink transfer roller 334 for transferring the ink from the roller to the sequential numbering unit 326. The impression roller 328 cooperates with the sequential numbering unit 326 to print the designated addressee code onto the coupon.

The sequential numbering unit 326 may be implemented using a rotary operated numbering printer available from Paul Leibinger Gmbh & Co. KG. This particular type of unit includes a printing head having a bar code which is employed to represent the addressee code to be printed on each coupon and a cam device which allows the addressee code to be advanced at each cycle in response to movement by the conveyor track.

After the printer 322, the coupons are transferred to pinch rollers 338 from which the coupons are passed to the conveyor track 110.

Figure 4A:
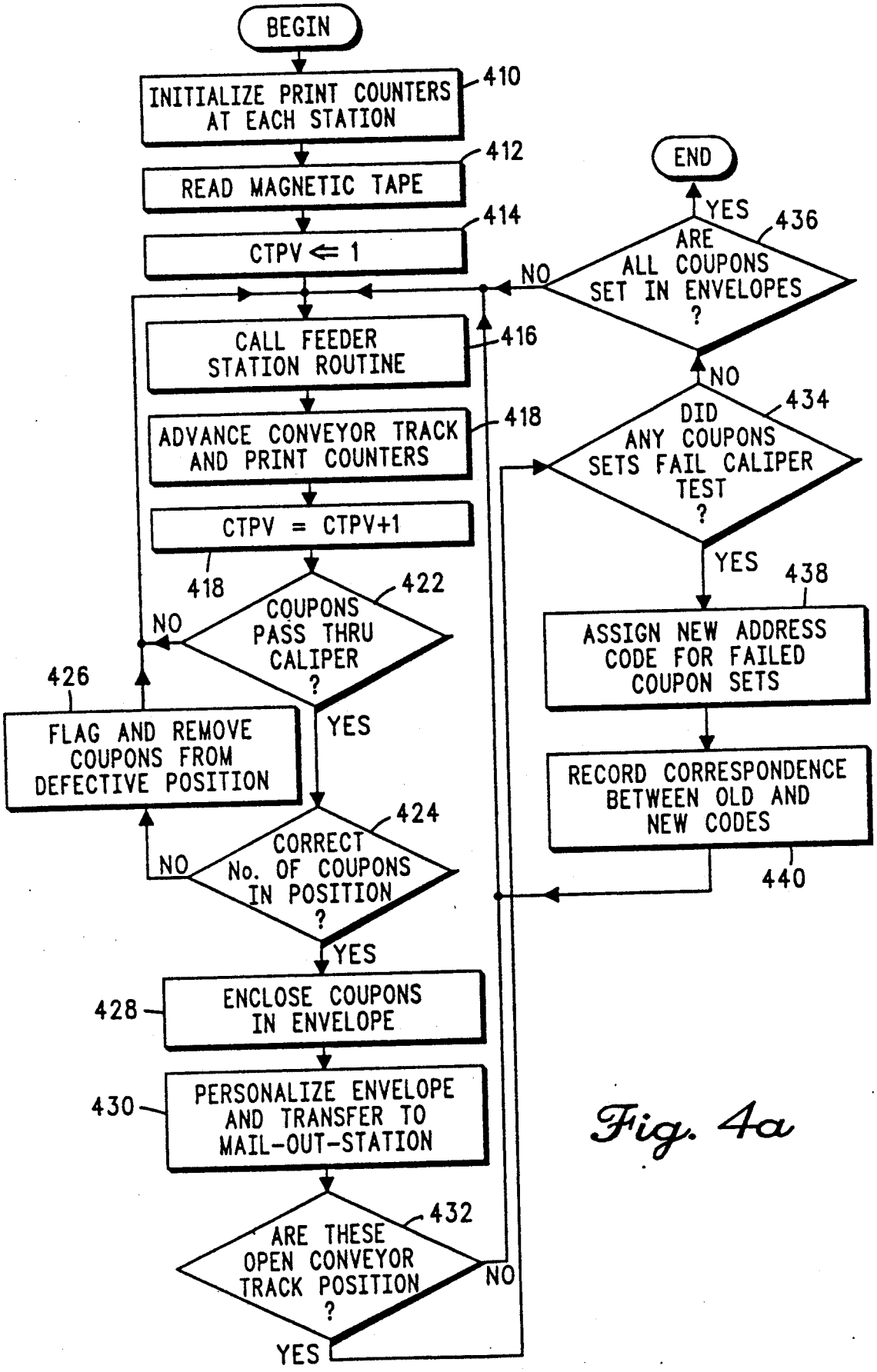
FIGS. 4*a*, 4*b* and 4*c* comprise a flow diagram of a gathering and personalization process, as set forth by the present invention, which may be used to implement the system illustrated in FIG. 1.
Figure 4B:
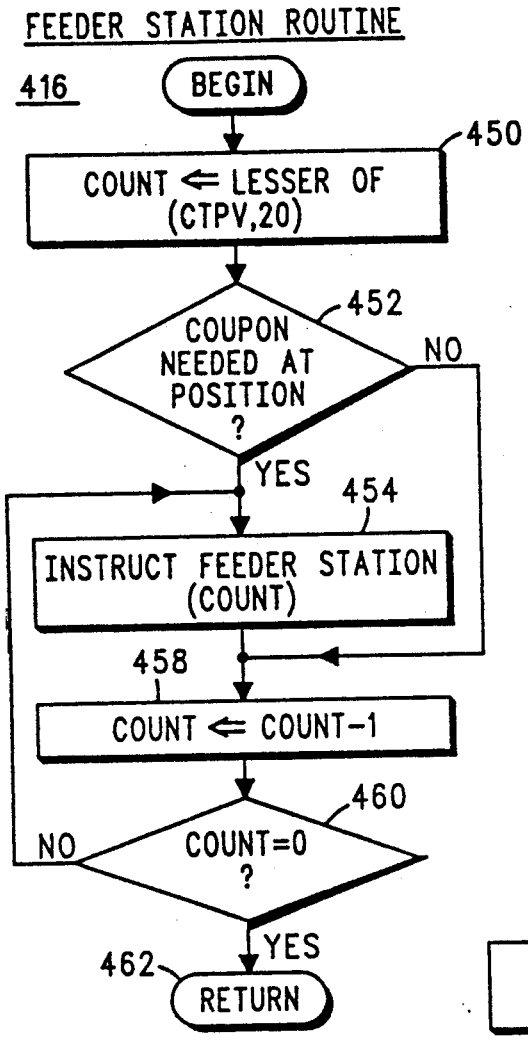
Figure 4C:
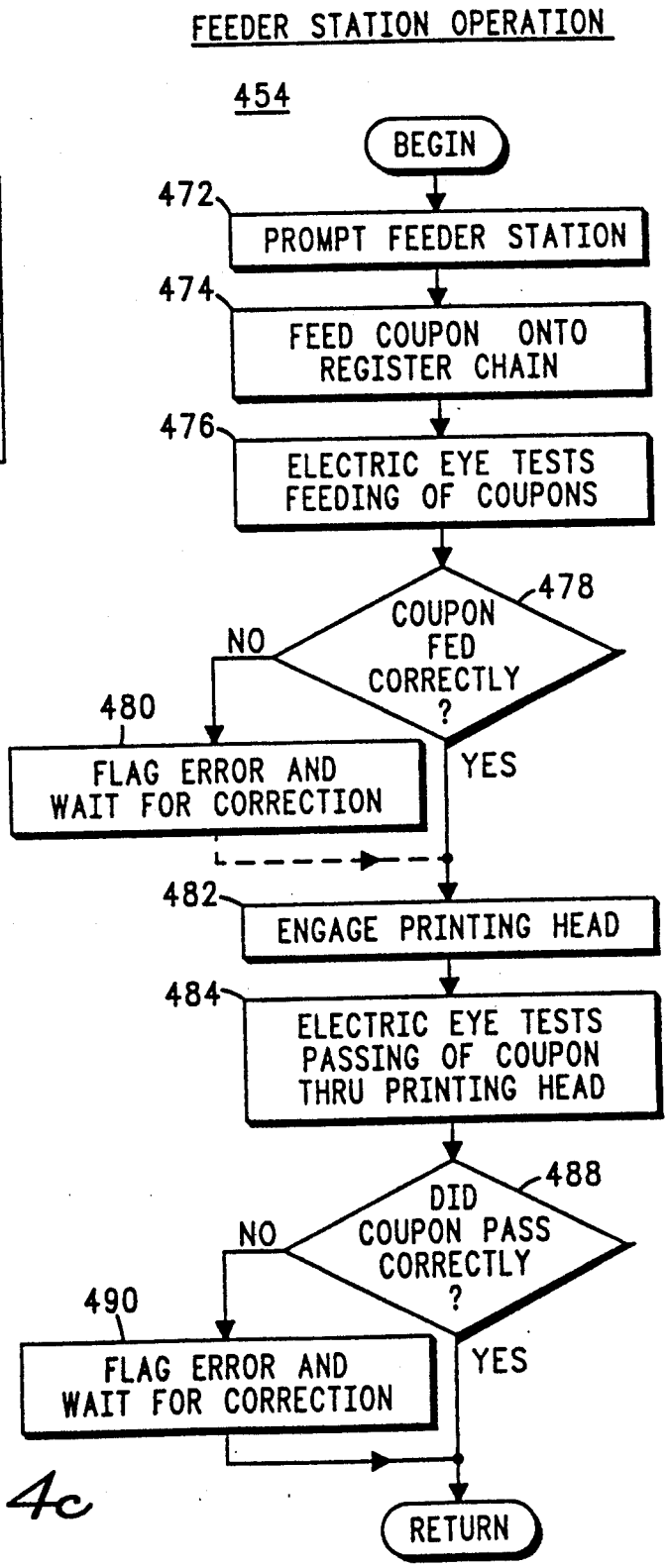

FIGS. 4*a*, 4*b* and 4*c* comprise a flow diagram of a gathering and personalization process, as set forth by the present invention, which may be used to implement the system illustrated in FIG. 1. The process begins at block 410 of FIG. 4*a* where each of the printing heads are initialized at the feeder stations. Preferably, the printing heads are initialized manually.

At block 412 the process controller reads the magnetic tape to obtain the addressee codes and to determine which addressee codes correspond to the coupons to be received. Before acting on the information read from the magnetic tape, the process controller initializes a conveyor track position variable (CTPV) to one. The conveyor track position variable is used to count the number of conveyor track positions that may receive coupons at any given time.

From block 414, flow proceeds to block 416 where the first interaction between the process controller and the feeder stations occurs. At block 416, a feeder station subroutine is called by the process controller. While this subroutine is described in detail in connection with FIG. 4*b*, generally, the feeder station subroutine instructs selected ones of the feeder stations 111-130 to code and feed one of their associated coupons pursuant to the information read from the magnetic tape 102.

After the selected feeder stations have been so instructed, flow proceeds to block 418 of FIG. 4*b*.

At block 418, the conveyor track 110 is advanced one position and, in response thereto, the counters associated with each of the feeder station printing heads also advance one position. Because the advancement of the conveyor track provides an additional conveyor track position for the feeder stations, CTPV is incremented to maintain a count of the number of coupon receivable conveyor track positions, depicted at block 420.

At block 422, a test is performed to determine if any coupons passed through the caliper (132 of FIG. 1). If not, no conveyor track positions with addressee coded coupons thereon have reached the caliper 132. In this case, flow returns to block 416 to process the newly added conveyor track position. If coupons did pass through the caliper 132, flow proceeds to block 424 where another test is performed.

The test at block 42 is performed to determine if the caliper measured the correct number of coupons that were designated by the information on the magnetic tape. The number of coupons designated may be established by the process controller via the leads 133 or, if each coupon set contains the same number of coupons, by fixing the caliper counting mechanism before the coupon gathering process begins. If the number of coupons passing through the caliper is incorrect, flow proceeds to block 426 where this error is recorded, and the coupons at that position are removed using the reject conveyor. Flow returns from block 426 to block 416.

Flow proceeds from block 424 to blocks 428 and 430 if the number of coupons passing through the caliper is correct. At block 428, the envelope hopper 136 of FIG. 1 receives the coupons from the conveyor track position and encloses the coupons in an envelope. At block 430 the envelope is personalized with customer information, for example, name and address.

From block 430 flow proceeds to block 432 where the process controller performs a test to determine if there are any open conveyor track positions. Open conveyor track positions indicate that all designated conveyor track positions have processed past the feeder station 111 of FIG. 1, in which case at least the conveyor track position in front of feeder station 111 is open. If there are no open conveyor track positions, flow returns to block 416.

If there are open conveyor track positions, flow proceeds to block 434 where a test is performed to determine if any uncorrected failures were recorded in connection with the processing of any coupon sets. An example of such an error is a miscounted number of coupons, as discussed in connection with block 426. If there are no uncorrected errors, flow proceeds from block 434 to block 436 where a test is performed to determine if all coupon sets have been enclosed in envelopes. If all coupon sets have not yet been enclosed in envelopes, the process continues at block 416. If all coupon sets have been enclosed in envelopes, since there are no errors to correct, from block 436 the process ends.

If one or more errors were recorded for any coupon set, the process controller prepares the coupon gathering system to rerun the erroneous coupon sets in subsequent conveyor track positions. This is accomplished, as depicted at blocks 438 and 440, by the process controller assigning and recording a new addressee code for each conveyor track position which carried an erroneous coupon set. The new addressee code is used in place of the previously used code so that the addressee package may be rerun from scratch. To avoid the necessity of resetting any of the printing heads, the new addressee code for each rerun coupon set is selected in sequence as the next unused addressee code. The correspondence between the new and the old addressee code is recorded by the process controller so that when the coupons are returned, there will be a record of the corresponding addressee as originally read from the magnetic tape. From block 440, flow returns to block 416 to continue gathering coupons for the newly assigned addressee code(s).

Referring now to FIG. 4*b*, the feeder station subroutine 416 of FIG. 4*a* is shown in detailed steps. The subroutine begins at block 450 of FIG. 4*b* where a variable referred to as COUNT is set equal to the conveyor track position variable (CTPV) or 20, whichever is less. COUNT is initialized to the maximum number of conveyor track positions which can receive addressee coded coupons and is incremented each cycle. For example, since the total number of feeder stations in FIG. 1 is 20, COUNT is set equal to 1 the first time the subroutine is called; after at least 20 conveyor track cycles, COUNT is set equal to 20.

At block 452, a test is performed by the process controller to determine if a coupon from the feeder station (COUNT) is required to be fed onto the conveyor track position presently before "feeder station (COUNT)." Reference to "feeder station (COUNT)" indicates the feeder station located in position number "COUNT", counting from right to left of FIG. 1. For example, feeder station (20) is feeder station 130 of FIG. 1, and feeder station (1) is feeder station 111 of FIG. 1. If a coupon is not required from the feeder station (COUNT), flow proceeds to block 458. If a coupon is required, flow proceeds to block 454.

At block 454, a set of steps is executed for the feeder station identified by COUNT. The steps at block 454 are described in detail in FIG. 4*c*. Briefly, these steps depict the operation of each feeder station in response to the process controller instructing the feeder station to feed a coupon from its coupon bin.

From block 454, flow proceeds to block 458 where COUNT is decremented and then to block 460 where a test is performed to determine if COUNT has been decremented to zero. This test indicates whether or not each of the feeder stations has had an opportunity to feed a coupon onto the conveyor track position currently before it. If COUNT has not decremented to zero, flow returns from block 460 to block 454 to allow a coupon to be fed from the next feeder station in line. If COUNT has been decremented to zero, flow returns from the steps of FIG. 4*b* to block 418 of FIG. 4*a*.

Referring now to FIG. 4*c*, block 454 of FIG. 4*b* is shown in expanded form. As referred to above, the steps depicted in FIG. 4*c* illustrate the operation of each feeder station in response to a feed instruction from the process controller.

This prompting occurs at block 472. In response to instructions received from the process controller, the feeder station feeds one of its coupons onto the register chain, depicted at block 474. At block 476, a first electric eye verifies that the coupon has been fed onto the register chain properly.

At block 478, a test is performed to determine if the coupon was fed properly. If the coupon has not been fed onto the register chain properly, flow proceeds from block 478 to block 480. In this instance, the error is flagged via conventional alarming means, and one of two things occur: either the system is shut down and the feeding error is corrected, or the misfed coupon is discarded and the process continues with the expectation that the caliper (132 of FIG. 1 will detect this misfeeding.

Flow proceeds from block 478 to block 482 if a coupon has been fed onto the register chain properly. At block 482, the printing head is engaged to print the addressee code to which it has been set. At block 484, a second electric eye verifies that the coupon has passed through the printing head properly.

A test is performed at block 488 which is similar to the test performed at block 478. The test at block 488 determines if the coupon passed through the printing head properly. If the coupon did not pass properly, flow proceeds to block 490 where the error is flagged and correction is awaited in an identical manner to that described in connection with block 480. If the coupon did pass correctly, flow returns from block 488 to block 458 of FIG. 4*b*.

Figures 5, 6A, 6B:
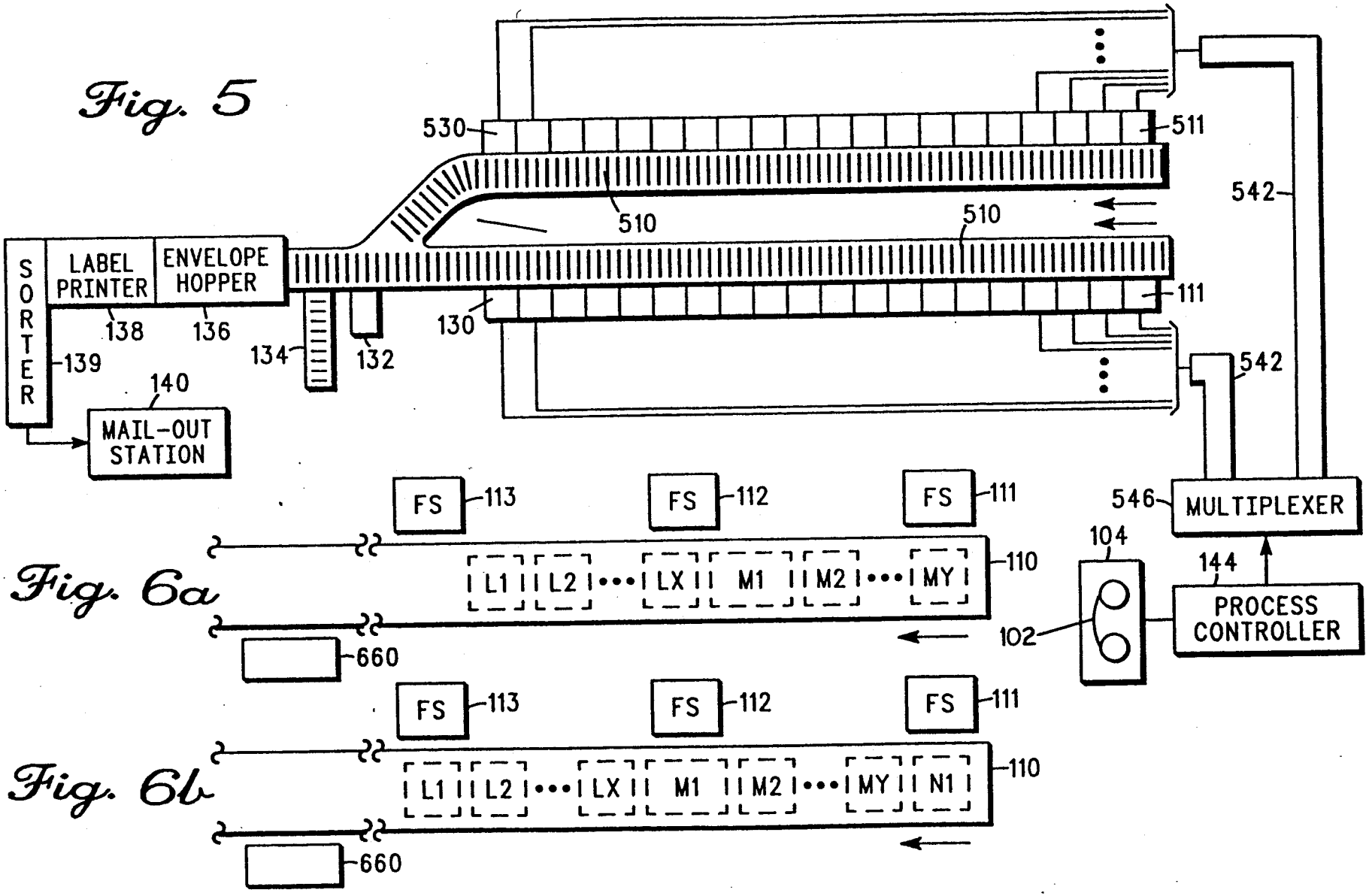
FIG. 5 is a block diagram of an alternate document gathering and personalization system, according to the present invention.
FIGS. 6*a* and 6*b* illustrate an alternate way of operating the system of FIG. 5, also in accordance with the present invention.

FIG. 5 illustrates a system which accomplishes the result of the system in FIG. 1 in a different way. The system shown in FIG. 5 operates in the same manner as the system shown in FIG. 1 except for the operation of the process controller 144, and the newly introduced conveyor track 510 and additional feeder stations 511–530. These differences provide a dual conveyor track 510, which allows the conveyor track positions to be alternately fed to the caliper 132 for greater processing power, and programmable control of the counting mechanisms at each feeder station.

The programmable control of the counting mechanisms avoids the necessity of manually setting the printing mechanism at each feeder station before commencing the process, e.g., the step depicted at block 410 of FIG. 4*a*. Additionally, rather than assigning a new addressee code to rerun a coupon set due to erroneous processing, the same addressee code is set remotely via this programmable control. This avoids the need to implement the steps depicted at blocks 438 and 440 of FIG. 4.

The programmable control is implemented using leads 542 to pass counting instructions via a conventional multiplexer 546. The multiplexer 546 is used in substantially the same manner as the multiplexer 146 of FIG. 1.

FIGS. 6*a* and 6*b* illustrate the operation of a system which accomplishes the result of the system in FIG. 1 in yet another way. The system operates in a modified manner from the previously discussed operation of the system shown in FIG. 1. The modifications include removing or disabling the printing functions from each of the feeder stations 111–130 and employing a printing station 660 along the conveyor track 110 of FIG. 1. An ink jet printing station may be used to implement the printing station 660, e.g., an ink jet printer available from Imaje, Inc. of Valance, France. The printing station 660 is situated directly over the conveyor track 110 at a height adequate for printing a coupon thereon. When a coupon passes underneath the printing head, the addressee code for the respective conveyor track position is printed.

FIGS. 6*a* and 6*b* show the control of this modified design in the form of designated conveyor track position movements along the conveyor track 110. Unlike the conveyor track position operation illustrated in FIGS. 2*a*–2*d*, where each position carries stacked coupons already printed with an addressee code, the addressee positions in the illustrations of FIGS. 6*a* and 6*b* include a plurality of positions for each addressee code, and each position carries only one coupon.

The printing station 660 prints the designated addressee code on each coupon while the coupons travel on the conveyor track. For example, the conveyor track positions for two addressee codes are shown in FIG. 6*a*. The positions associated with the first addressee code are L1, L2 . . . LX, while the positions associated with the second addressee code are M1, M2 . . . MY, where X and Y are positive integers which are preselected based on the total number of coupons which are to be fed for each addressee.

FIG. 6*b* illustrates the state of the conveyor track with respect to the feeder stations 111, 112 and 113 after one cycle. FIG. 6*b* includes the processing of conveyor track position N1 associated with a third addressee code.

Figure 7:
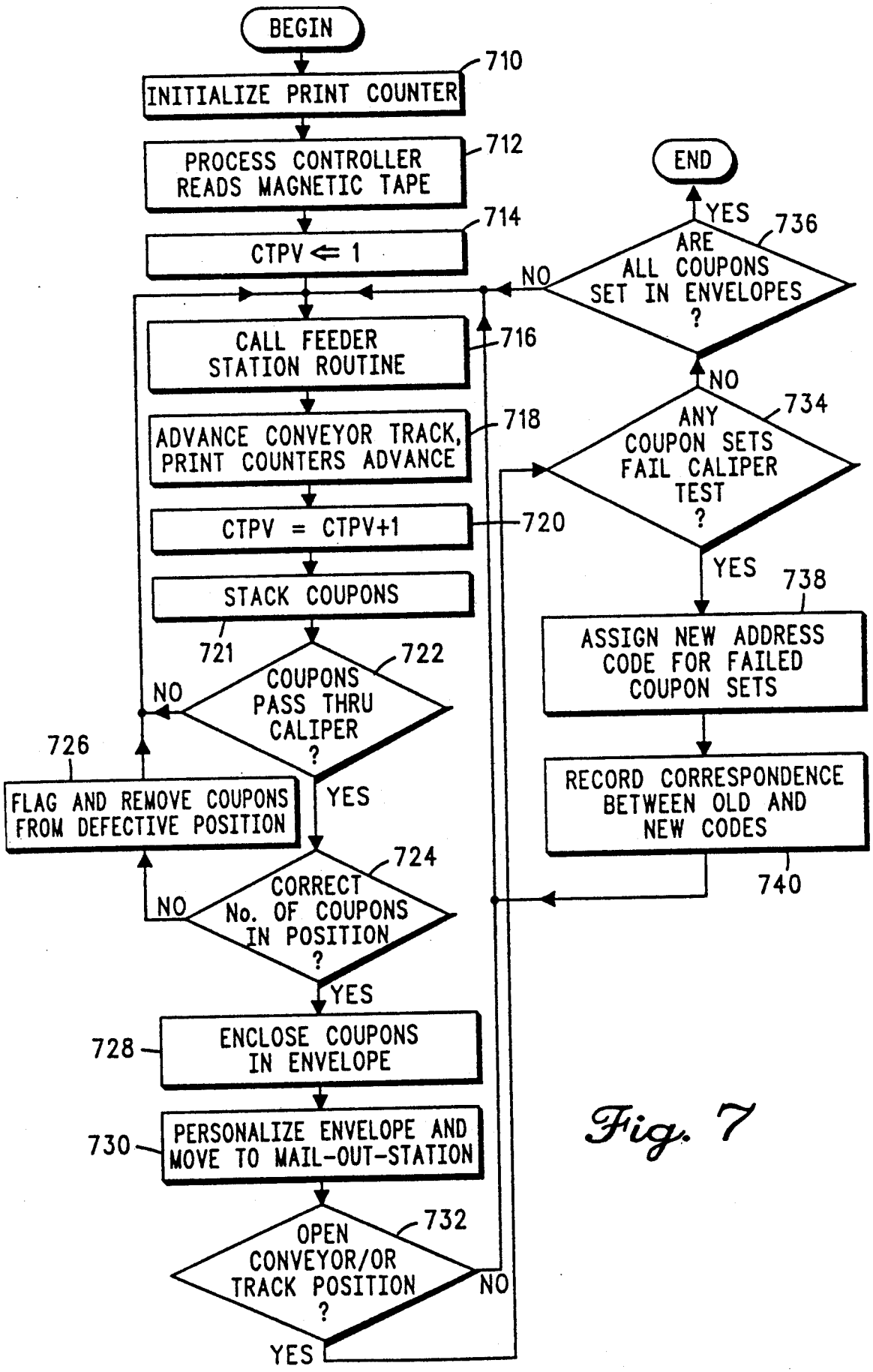
FIG. 7 is a partial flow diagram, as set forth by the present invention, which may be used to implement the system described in connection with FIGS. 6*a* and 6*b*.

In FIG. 7, a flowchart illustrates the preferred manner in which this modified system may operate. The blocks in FIG. 7 have been labeled with reference numerals which correspond to similar blocks in FIG. 4*a*, i.e., block 410 corresponds to block 710, block 412 corresponds to block 712, etc. Each of the blocks of FIG. 7 corresponds to a block in FIG. 4*a*, except for block 721 of FIG. 7. There are, however, several differences.

For example, block 710 of FIG. 7 differs from block 410 FIG. 4*a* At block 710, the print counter is initialized at the print station 660 rather than at the feeder stations 111–130. Selection for the addressee codes printed by the print counters may be provided by communication from the process controller 144 via leads 133 of FIG. 1. Alternatively, counters such as those described in connection with FIG. 3 may be used with a counting-increment mechanism occurring every Xth cycle, provided that each addressee receives the same number of coupons.

Another difference involves block 721 of FIG. 7 which does not correspond to any block of FIGS. 4*a*–4*c*. Block 721 depicts how the multiple positions are accommodated for each addressee. Before the coupons are passed through the caliper and enclosed in envelopes, the coupons for each respective addressee code are gathered into a stack. This allows the coupons associated with each addressee code to be processed by the caliper 132 and the subsequent equipment in the same manner as described in connection with FIG. 4*a*.

An additional difference involves the steps depicted in FIG. 4*c*. The steps in FIG. 4*c* differ in that steps 482, 484, 488 and 490 are bypassed in the modified system operation of FIG. 1. Thus, after execution of the step depicted at block 478 or 480, flow returns to block 458 of FIG. 4*b*.

While the invention has been particularly shown and described with reference to multiple embodiments, as mentioned above, it will be understood by those skilled in the art that various other modifications and changes may be made as well. For example, the system illustrated in FIG. 1 may be modified to include a separate conveyor track for each feeder station. This type of modification would also include means for gathering the coupons from the various conveyor tracks and enclosing the gathered coupons into envelopes. Such modifications and changes do not depart from the spirit and scope of the present invention which is set forth by the following claims.

I claim:

1. A system for gathering response documents into sets that are individually customized for different addressee types, comprising:

a plurality of document groups, wherein each group contains a plurality of associated response documents;

a list of addressee information and addressee codes for identifying the addressee types and for designating response documents from selected ones of the document groups for each of the addressee types;

a plurality of feeder units, wherein each feeder unit is disposed adjacent to each document group for removing response documents therefrom;

inscription means, responsive to said plurality of feeder units, for inscribing said addressee codes on said response documents;

collection means, responsive to said feeder units and said inscription means and including a moving conveyor track, for collecting the addressee coded response documents from certain ones of the document groups; and processing means, responsive to said recorded list and coupled to said plurality of feeder units, for selectively controlling the feeding and inscribing of the associated response documents;

said processing means including means for setting a respective one of the addressee codes to be inscribed by each of said inscription means according to a prescribed sequence of addressee codes to be collected into the conveyor track, and means, responsive to movement of the conveyor, for changing the addressee code to be inscribed by each of said inscription means to the next addressee code in the prescribed sequence;

wherein the addressee coded response documents are collected into the document sets such that the response documents of each set are inscribed with the same addressee code.

2. A system, as set forth in claim 1, wherein the inscription means includes a counting mechanism for tracking the addressee code to be inscribed on each response document.

3. A system, as set forth in claim 2, wherein the inscription means includes a bar code printer for printing the addressee code.

4. A system, as set forth in claim 1, wherein the conveyor track is situated adjacent to each of the plurality of feeder units such that each feeder unit feeds its associated response document to the conveyor track.

5. A system, as set forth in claim 4, wherein the inscription means is located adjacent to the conveyor track and separate from the plurality of feeder units.

6. A system, as set forth in claim 1, wherein the inscription means includes a plurality of inscribers wherein each inscriber is co-located with and coupled with one of said plurality of feeder units such that one of the addressee codes may be inscribed on each associated response document in response to the feeder unit's removal of each response document from the respective document group.

7. A system for gathering documents into sets that are individually customized for different addressee types, comprising:

a plurality of feeder stations for providing addressee coded documents, each feeder station including:

a group of associated documents, an inscriber for inscribing one of the addressee codes on the associated documents, and a document feeder for feeding the associated documents;

a recorded list of addressee codes for identifying the addressee types and for designating documents from selected ones of the document groups for each of the addressee types;

collection means, responsive to said plurality of feeder stations and including a moving conveyor track, for collecting addressee coded documents from certain ones of the groups; and processing means, responsive to said list and coupled to said plurality of feeder stations, for controlling the collection of said addressee coded documents;

said processing means including means for setting a respective one of the addressee codes to be inscribed by each of said inscription means according to a prescribed sequence of addressee codes to be collected onto the conveyor track, and means, responsive to movement of the conveyor, for changing the addressee code to be inscribed by each of said inscription means to the next addressee code in the prescribed sequence;

wherein the addressee coded response documents are collected such that the documents of each set are inscribed with the same addressee code.

8. A system, as set forth in claim 7, wherein the inscriber includes a counting mechanism for tracking the addressee code to be inscribed on each document.

9. A system, as set forth in claim 7, wherein the inscriber includes a bar code printer for printing the addressee code.

10. A system, as set forth in claim 7, wherein the conveyor track is situated adjacent to each of the plurality of feeder stations such that each feeder station feeds its associated document to the conveyor track.

11. A system, as set forth in claim 7, wherein the collection means includes a plurality of conveyor tracks each of which is situated adjacent to each of the plurality of feeder stations such that each feeder station feeds its associated document to the adjacent conveyor track.

12. A system, as set forth in claim 7, wherein each feeder station feeds the associated documents after the addressee code is inscribed thereon.

13. A system, as set forth in claim 7, wherein the addressee code corresponds to an addressee having a unique postal address.

14. A system for gathering response documents into sets that are individually customized for specified addressee types, comprising:

a list of addressee information and codes for identifying the specified addressee types and for designating documents from selected ones of the document groups for each of the addressee types;

a plurality of feeder stations for providing documents, each feeder station including:

a group of associated documents, and a document feeder for feeding the associated documents;

collection means, responsive to said plurality of feeder stations and including a moving conveyor track, for collecting the documents from certain ones of the groups in their associated feeder stations;

an inscriber, cooperatively coupled with said collection means, for inscribing one of the addressee codes on each of the associated documents, and processing means, responsive to said list and coupled to said plurality of feeder stations and to the inscriber, for controlling feeding of the documents and the collection of said addressee coded documents;

said processing means including means for setting a respective one of the addressee codes to be inscribed by each of said inscription means according to a prescribed sequence of addressee codes to be collected onto the conveyor track, and means, responsive to movement of the conveyor, for changing the addressee code to be inscribed by each of said inscription means to the next addressee code in the prescribed sequence;

wherein the addressee coded response documents are collected such that the documents of each set are inscribed with the same addressee code.

15. A system for gathering response documents into sets that are individually customized for addressee types, comprising:

a list of addressee information and codes for identifying the specified addressee types and for designating documents from selected ones of the document groups for each of the addressee types;

processing means, responsive to said list, for providing signals to indicate which of the addressee types are to receive documents and which of the documents each addressee type is to receive;

a plurality of feeder stations, responsive to said signals, for providing addressee coded documents in response to said signals, each feeder station including:

a group of associated documents, a mechanically operated numbering printer for printing one of the addressee codes on the associated documents, and a document feeder for feeding the associated documents; and a conveyor system, responsive to said plurality of feeder stations and including a conveyor track, for collecting addressee coded documents into the document sets and for changing the number to be printed by the mechanically operated numbering printer;

wherein the processing means is coupled to said plurality of feeder stations to control the collection of said addressee coded documents, and said processing means including means for setting a respective one of the addressee codes to be inscribed by each of said inscription means according to a prescribed sequence of addressee codes to be collected onto the conveyor track, and means, responsive to movement of the conveyor, for changing the addressee code to be inscribed by each of said inscription means to the next addressee code in the prescribed sequence;

wherein the addressee coded response documents are collected such that the documents of each set are inscribed with the same addressee code.

16. A method for gathering response documents into sets that are individually customized for specified addressee types, comprising the steps of:

storing a group of documents at each of a plurality of feeder stations, wherein each group contains a plurality of documents;

providing a list of addressee information and codes for identifying the specified addressee types and for designating documents from selected ones of the document groups for each of the addressee types;

processing the list, by:

generating signals to indicate which of the addressee types are to receive documents and which of the documents each addressee type is to receive;

in response to said signals at each of said feeder stations:

using a mechanically operated numbering printer having numbers which respectively represent the addressee types, initializing the addressee code to be initially printed by each of said numbering printers such that the addressee codes are sequentially numbered with respect to their linear arrangement, printing one of the addressee codes on the associated documents, and feeding the associated documents and incrementing the number on the numbering printer; and using a conveyor system and responsive to said step of feeding, collecting the fed addressee coded documents into the document sets;

wherein the signals are provided to the feeder stations to control the collection of said addressee coded documents such that the documents of each set are inscribed with the same addressee code.

17. A method for gathering coupons into sets that are individually customized for specified addressee types, comprising the steps of:

(a) providing a list of addressee information and codes for identifying the specified addressee types and for designating documents from selected ones of the document groups for each of the addressee types;

(b) processing the listed addressee types, by:

providing signals to indicate which of the addressee types are to receive coupons and which of the coupons each addressee type is to receive;

(c) providing a plurality of feeder stations in a linear arrangement and, at each feeder station, including:

a group of associated coupons and a mechanically operated numbering printer to print the addressee codes;

(d) initializing the addressee code to be initially printed by each of said numbering printers such that the addressee codes are sequentially numbered with respect to their linear arrangement;

(e) at each feeder station and in response to said signals:

printing one of the addressee codes on one of the associated coupons, and feeding the addressee code printed coupon;

(f) in response to the feeding of the addressee code printed coupons, changing the addressee code to be printed by each of said numbering printers;

(g) using a conveyor system and in response to said step of feeding the associated coupons, collecting the fed addressee coded coupons into the coupon sets and changing the number to be printed by the mechanically operated numbering printer;

wherein the signals are provided to the feeder stations to control the collection of said addressee coded coupons such that the coupons of each set are inscribed with the same addressee code.

18. A method for gathering coupons into sets, according to claim 17, further including the steps of determining whether or not coupons were erroneously included into one of the coupon sets; in response to the determination that coupons were erroneously included into one of said coupon sets, assigning and recording a new addressee code; and repeating steps (e), (f) and (g) for said coupon set corresponding to the new addressee code.

* * * * *